United States Patent [19]

Cummins

[11] Patent Number: 4,489,526

[45] Date of Patent: Dec. 25, 1984

[54] DRILL RIG ELEVATING FLOOR STRUCTURE

[75] Inventor: Bruce M. Cummins, Spring, Tex.

[73] Assignee: Skytop Brewster Company, Conroe, Tex.

[21] Appl. No.: 473,237

[22] Filed: Mar. 8, 1983

[51] Int. Cl.[3] ..... E04H 12/34

[52] U.S. Cl. ..... 52/125.6; 52/116; 52/125.2; 182/141

[58] Field of Search ..... 52/125.2, 125.6, 122.1, 52/126.5, 111, 119, 116; 182/141

[56] References Cited

U.S. PATENT DOCUMENTS

| | | | |
|---|---|---|---|
| 3,110,359 | 11/1963 | Solomon | 182/141 |
| 3,136,394 | 6/1964 | Woolslayer | 52/119 |
| 3,271,915 | 9/1966 | Woolslayer et al. | 52/122 |
| 3,333,377 | 8/1967 | Woolslayer | 52/116 |
| 3,483,933 | 12/1969 | Dyer et al. | 173/39 |
| 3,747,695 | 7/1973 | Branham | 173/151 |
| 3,803,780 | 4/1974 | Donnally | 52/116 |
| 3,807,109 | 4/1974 | Jenkins et al. | 52/120 |
| 3,922,825 | 12/1975 | Eddy et al. | 52/116 |
| 4,135,340 | 1/1979 | Cox et al. | 52/115 |

*Primary Examiner*—Henry E. Raduazo

*Attorney, Agent, or Firm*—Richards, Harris & Medlock

[57] ABSTRACT

An improved oil well drilling rig structure (10) is provided. The drilling rig structure (10) includes a base (32) for placement on the ground at a well site. The base (32) includes first and second ends (32*a*, 32*b*). A drill floor (14) supported on a floor box (12) having first and second ends (12*a*, 12*b*) is disposed parallel to and adjacent the first end (32*a*) of the base (32). The floor box (12) is coupled to the base (32) by spaced apart parallel legs (76, 78) each pivotally attached between the upper box (12) and the base (32) for elevating the floor (14) from a low position adjacent to the first end (32*a*) of the base (32) to an elevated position medially between the ends (32*a*, 32*b*) of the base (32) and located above the base (32) by rotation of the legs (76, 78) towards a vertical position. The structure (10) further includes a tensile link (40) having first and second ends (40*a*, 40*b*). The first end (40*a*) of the tensile link (40) is coupled adjacent the second end (12*b*) of the floor box (12) opposite the first end (32*a*) of the base (32). A thrust link (42) is provided having first and second ends (42*a*, 42*b*). The first end (42*a*) of the thrust link (42) is coupled adjacent to the second end (40*b*) of the tensile link (40). The second end (42*b*) of the thrust link (42) is pivotally coupled adjacent the second end (32*b*) of the base (32). Power driving structure (60) is connected to the base (32) and the links (40, 42) for drawing the second end (40*a*) of the tensile link (40) to a pin linkage position on the base (32) adjacent the second end (32*b*) of the base (32) as the legs (76, 78) approach the vertical position.

9 Claims, 7 Drawing Figures

DRILL RIG ELEVATING FLOOR STRUCTURE

TECHNICAL FIELD

This invention relates to drilling rigs, and more particularly to a structure for the erection of a high floor drilling rig.

BACKGROUND ART

In the drilling of exploratory wells such as oil wells, rigs are employed which can be transported to a site and assembled in place to perform the drilling operation. It is necessary to provide elevated drill floors to provide a space thereunder for equipment, such as, for example, safety devices and blowout preventers. The drilling rig must have a base suitable to support the rig on infirm soil so that the weight of the rig and the drilling equipment supported on the floor will be distributed over the base for transfer to the surface of the earth.

Previously developed elevating structures have included the system described in U.S. Pat. No. 4,135,340 issued to Cox et al on Jan. 23, 1979 and entitled "Modular Drill Rig Erection Systems". However, such systems have involved difficult loading and pin connections.

The need exists for an elevatable floor structure in a drill rig which allows for all pin connections to be made at ground level upon raising of the floor. Relative ease and efficient installation and erection of a high level drill floor as it supports the tower portion of the drilling rig are highly desirable. Additionally, a need has arisen for a drilling rig wherein floor substructure can readily be installed with the necessary level of stability.

DISCLOSURE OF THE INVENTION

In accordance with the present invention, a drill rig elevating floor structure is provided which substantially eliminates major problems heretofore associated with drill rig erection.

In accordance with the present invention, an improved oil well drilling rig includes an elongated base for placement on the ground at a well site. The base has first and second ends and opposite sides. A drill floor of length shorter than the base initially rests at low level on the base and has first and second ends with the first end disposed parallel to and adjacent the first end of the base. The floor is coupled to the base by two pairs of spaced apart parallel substantially horizontal legs with each pair being pivotally attached between the floor and the base for elevating the floor from a low level to a position medially between the ends of the base and above the base. This is accomplished by forcing rotation of the legs towards a vertical position.

The elevating structure includes a rigid tensile link having a first end coupled to the second end of the floor at low level. A thrust link is coupled between a pivot near the second end of the tensile link initially at high level and a pivot adjacent the second end of the base. Power driving structure is connected between the base and the region common to the links for forcing the second end of the tensile link to an anchor on the base adjacent the second end of the base as the legs approach the vertical position.

BRIEF DESCRIPTION OF DRAWINGS

For a more complete understanding of the present invention and for further advantages thereof, reference will now be made to the following Detailed Description taken in conjunction with the accompanying Drawings in which.

DETAILED DESCRIPTION

Figure 1:
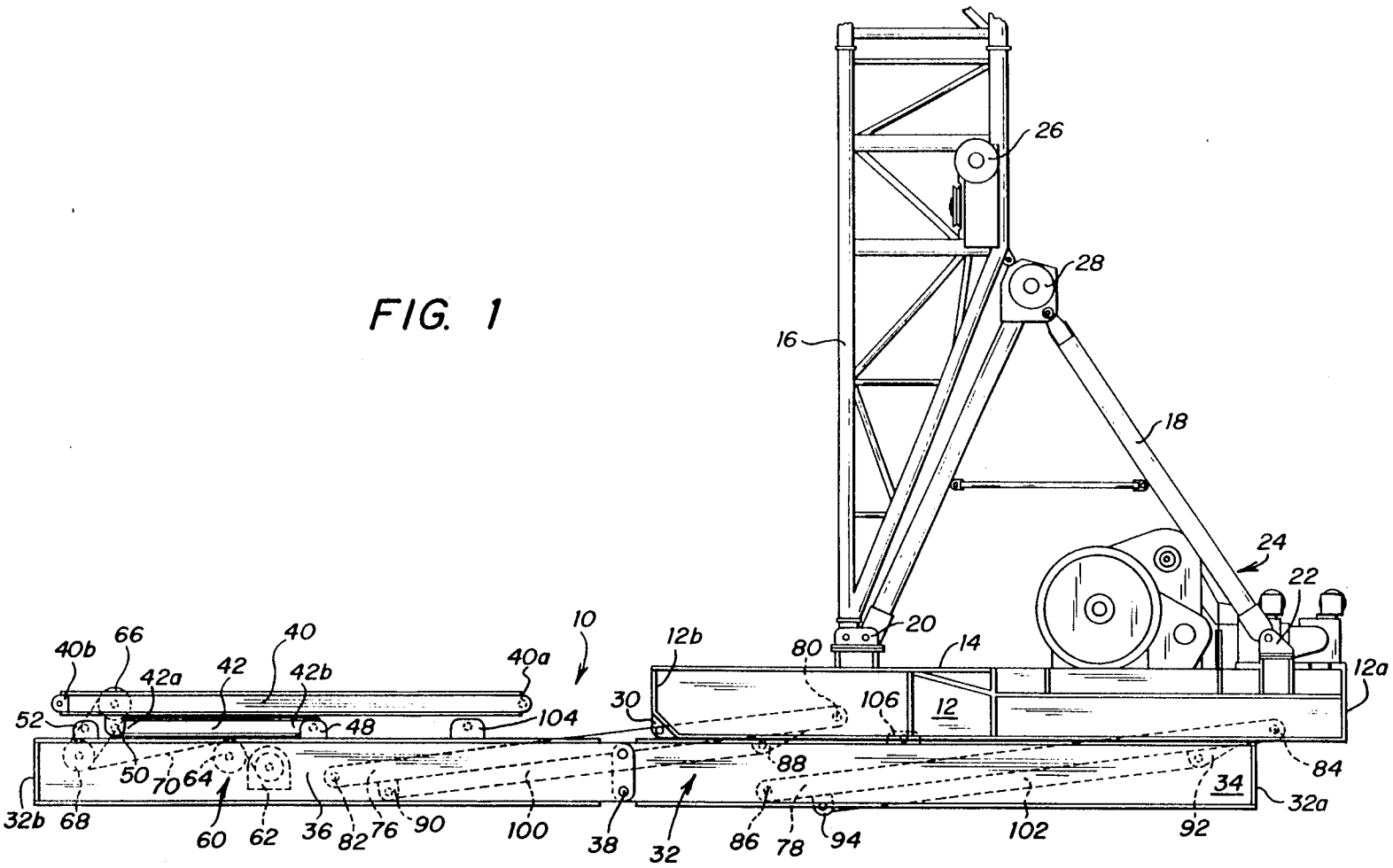
FIG. 1 is a side elevation of the present drilling rig elevating floor structure illustrating the structure prior to elevation of the floor with the mast and A-frame fully assembled.

Referring to FIG. 1, the present drill rig elevating floor structure is illustrated and is generally identified by the numeral 10. Structure 10 includes an upper box 12 having a first end 12*a* and a second end 12*b*. Upper box 12 supports a floor 14 and a conventional mast 16 and A-frame structure 18. Mast 16 and A-frame structure 18 are pivotally supported on shoes 20 and 22. Floor 14 further supports a drawworks assembly generally identified by the numeral 24. Drawworks assembly 24 is used to elevate mast 16 and A-frame structure 18 utilizing sheaves 26 and 28 together with drill lines and sling lines (not shown) as is well known. A pin location 30 is provided at end 12*b* on upper box 12.

Structure 10 further includes a lower box or base 32 having a first end 32*a* and a second end 32*b*. Base 32 is longer than floor box 12 and for ease in transport may be comprised of half sections 34 and 36 which are pinned together at the center of base 32 at pin location 38. As illustrated in FIG. 1, initially floor box 12 rests at a low level on top of base 32. The first end 12*a* of floor box 12 is adjacent first end 32*a* of base 32.

Figure 5:
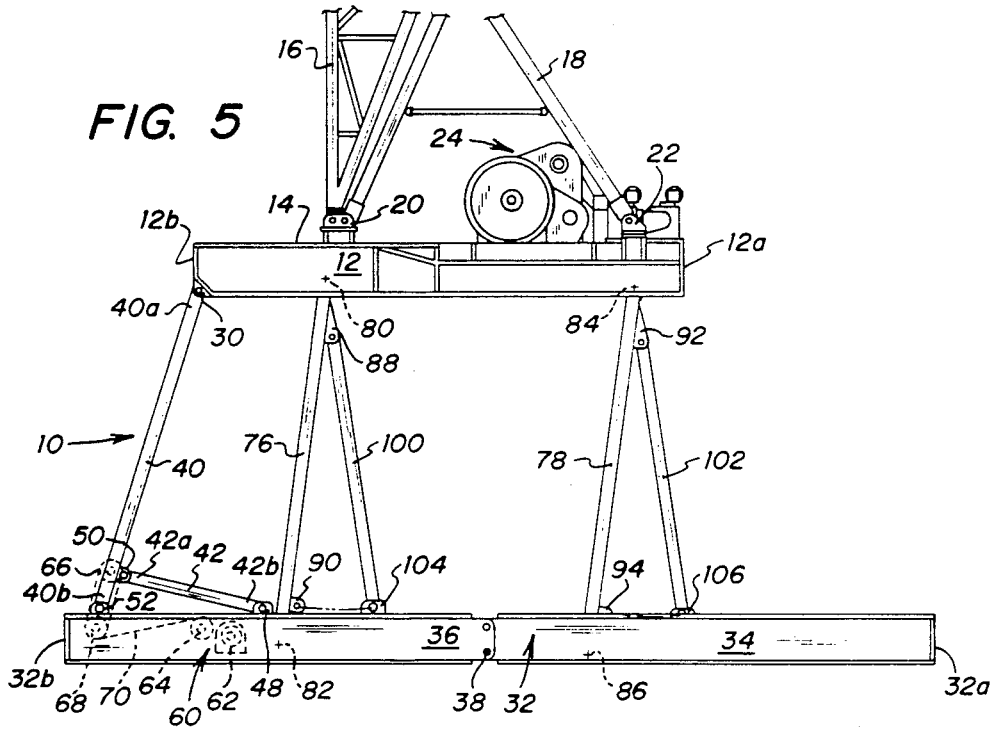
FIG. 5 is a side elevation of the present structure illustrating full erection of the drill rig floor.

A tensile link 40 having ends 40*a* and 40*b* is shown partially dissembled and lying horizontal and parallel to base 32. A thrust link 42 has ends 42*a* and 42*b* with end 42*b* pivotally connected to a flange 48 mounted to base 32. End 42*a* of link 42 is pivotally connected to a flange 50 carried by link 40 adjacent end 40*b*. As shown in FIG. 1, link 42 is parallel to link 40 prior to completion of assembly for raising upper box 12. Base 32 further includes a flange 52 for pinning end 40*b* of link 40 in the final elevated position of structure 10 (FIG. 5).

The reeving structure for structure 10 is generally identified by the numeral 60. Reeving structure 60 includes a winch 62, a fleet angle compensator 64 and sheave clusters 66 and 68. Sheave cluster 66 is mounted to tensile link 40. Sheave cluster 68 is mounted to base 32 adjacent end 32*b*. A wireline 70 is reeved around sheave clusters 66 and 68 and passes over fleet angle compensator 64 and is spooled on winch 62.

Structure 10 further includes legs 76 and 78 which are parallel to each other and interconnected between upper box 12 and base 32. Leg 76 is pivotally connected to upper box 12 at pivot point 80 and is pivotally connected to base 32 at pivot point 82. Leg 78 is pivotally connected to upper box 12 at pivot point 84 and is pivotally connected to base 32 at pivot point 86. Leg 76 includes flanges 88 and 90. Leg 78 includes flanges 92 and 94.

Structure 10 further includes supports 100 and 102. Support 100 is pivotally connected to flange 88 of leg 76 and is temporarily interconnected to flange 90 of leg 76. Support 102 is pivotally connected to flange 92 of leg 78, and is temporarily interconnected to flange 94 of leg 78. Base 32 further includes flanges 104 and 106 for pinning the bottom ends of supports 100 and 102, respectively, when floor box 12 is in the elevated position (FIG. 5).

FIG. 1 and the subsequent FIGS. 2–5 illustrate structure 10 by showing one side of structure 10. It should be understood that on the opposite side (not shown) a similar elevating structure 10 is provided. An addition set of links 40 and 42; legs 76 and 78; supports 100 and 102; and reeving structure 60 is also provided on the opposite side of structure 10 which is not illustrated in the FIGURES. Mast 16 is assembled and erected above floor 14 in accordance with conventional practice preparatory to elevation of floor box 12 in accordance with the present invention.

Figure 2:
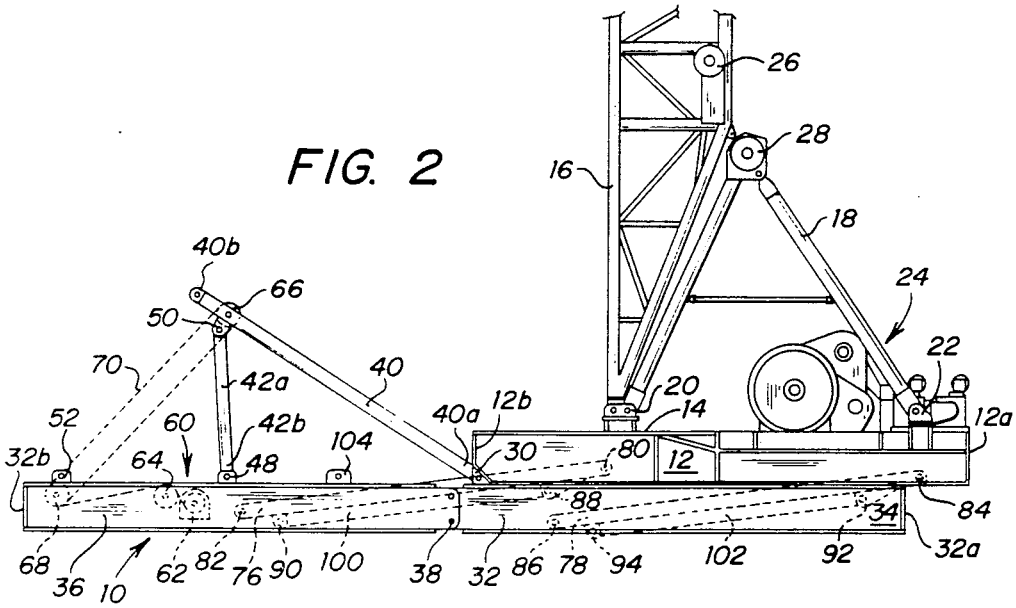
FIG. 2 is a side elevation of the present structure illustrating the initial link connection prior to floor elevation.

Referring now to FIG. 2 it is to be understood that link 40 is a rigid tensile link or drawbar and link 42 is a rigid thrust link. The initial positions of links 40 and 42 are illustrated prior to the commencement of elevation of floor box 12. End 40*a* of link 40 is pinned to pin location 30 of upper box 12. With link 40 in the initial position, link 42 is substantially vertical above base 32. Legs 76 and 78 and supports 100 and 102 shown in FIG. 2 are in the same position as shown in FIG. 1.

Figure 3:
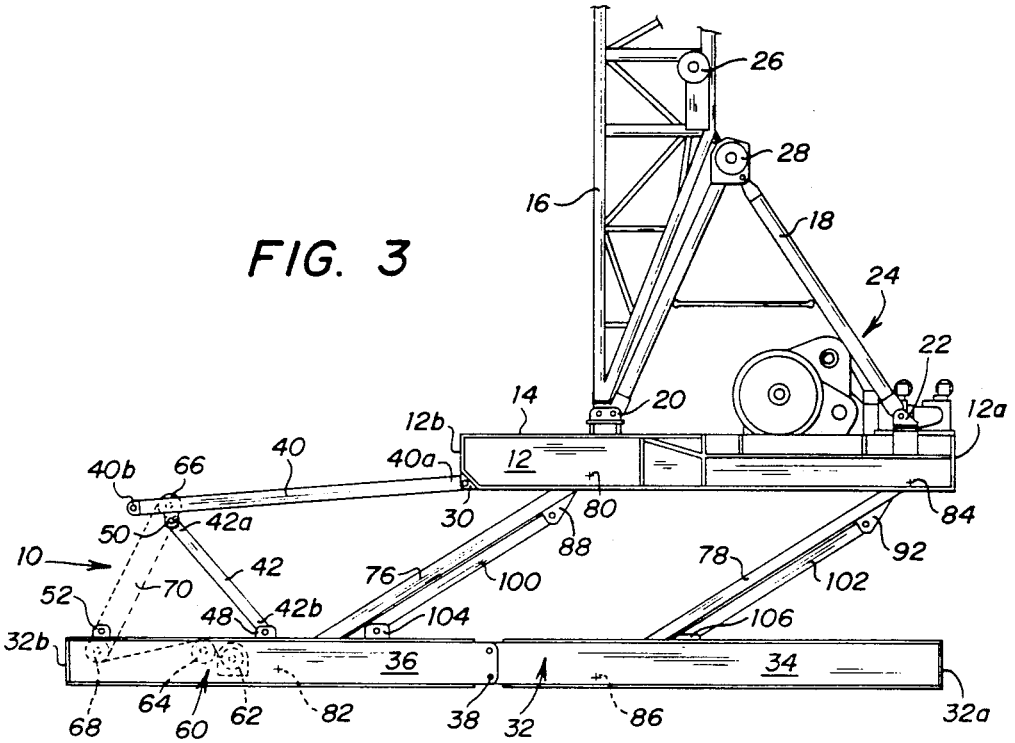
FIGS. 3 and 4 are side elevations of the present structure illustrating the structure during floor elevation.
Figure 4:
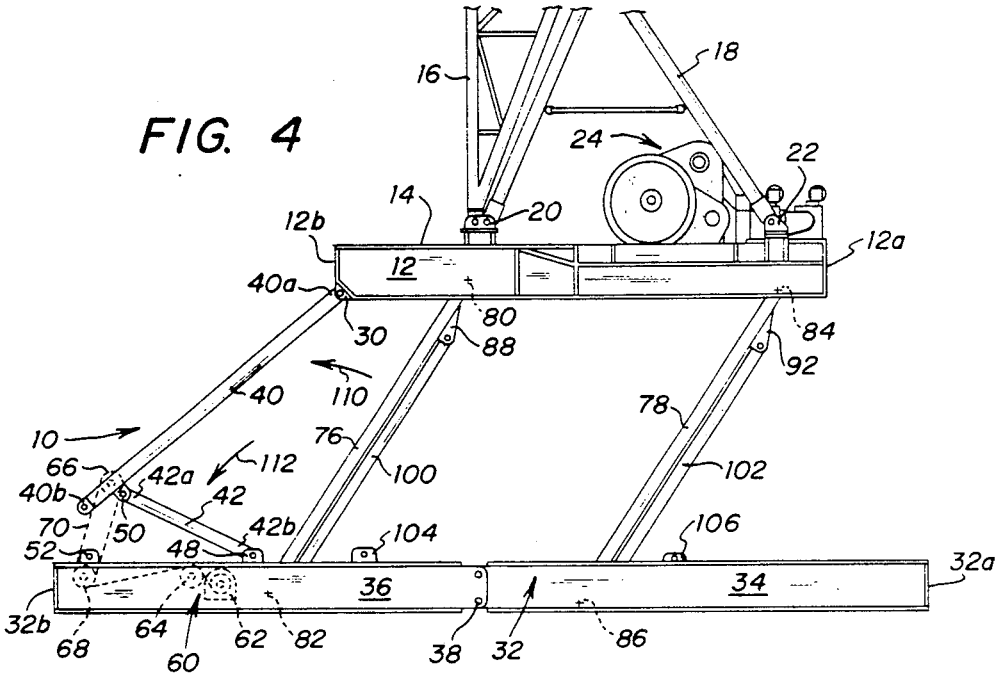

Referring to FIGS. 3, 4 and 5, the elevation of floor box 12 using the present structure 10 will now be described. As wireline 70 is spooled up on winch 62, tension is developed in wireline 70 and in tensile link 40 while compression is developed in thrust link 42. The tension in link 40 causes floor box 12 with floor 14 to rise as illustrated in FIG. 3. Supports 100 and 102 are locked parallel to legs 76 and 78, respectively. Leg 76 pivots at pivot points 80 and 82 while leg 78 pivots at pivot points 84 and 86 as tensile link 40 is drawn to a horizontal position.

As illustrated in FIG. 4, legs 76 and 78 continue to pivot in the direction of arrow 110. Link 40 is now rotated from the substantially horizontal position shown in FIG. 3 to a position substantially parallel to legs 76 and 78 as thrust link 42 continues to rotate in the direction indicated by arrow 112.

FIG. 5 illustrates the final elevated position of floor box 12. End 40*b* of link 40 is pinned to flange 52 near the end 32*b* of base 32. To complete the rig erection, support 100 is detached from flange 90 of leg 76 and is pivoted to and pinned at flange 104 of base 32. Similarly, support 102 is detached from leg 78 at flange 94 and is pivoted to and pinned at flange 106 of base 32. Supports 100 and 102 provide improved longitudinal stability for floor box 12.

Figure 6:
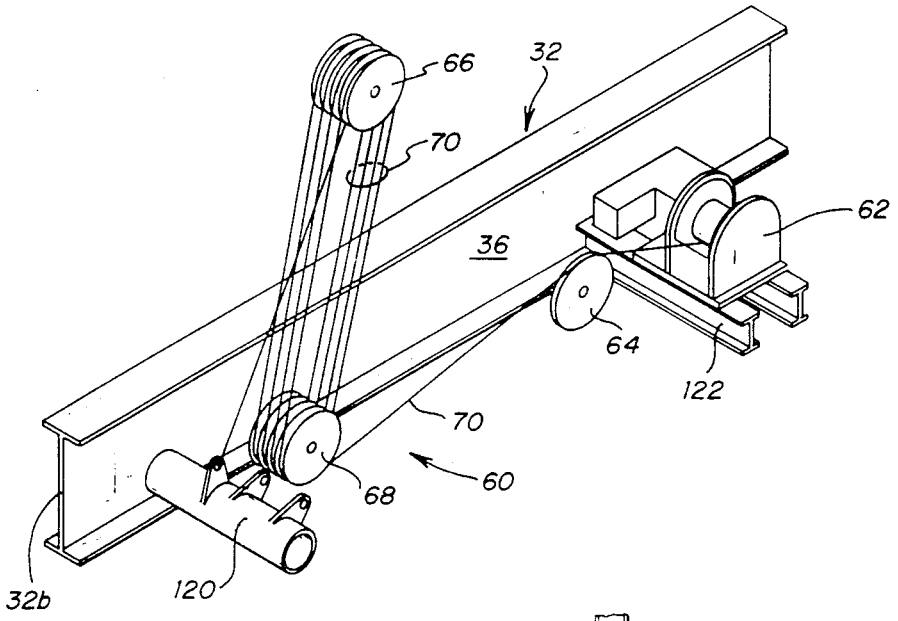
FIG. 6 is a perspective view of the reeving structure.

FIG. 6 illustrates reeving structure 60 in greater detail. Sheave cluster 68 is mounted to half section 36 of base 32 using support structure 120. Similarly, winch 62 is mounted to base 32 using support structure 122. Fleet angle compensator 64 adjusts the entry angle of wireline 70 as it enters the drum of winch 62 to promote smooth spooling of wireline 70 on the drum of winch 62. Although structure 10 has been described for use with a wireline 70, alternatively, the present structure 10 can be utilized with hydraulic rams which may be substituted for the wireline arrangement.

Figure 7:
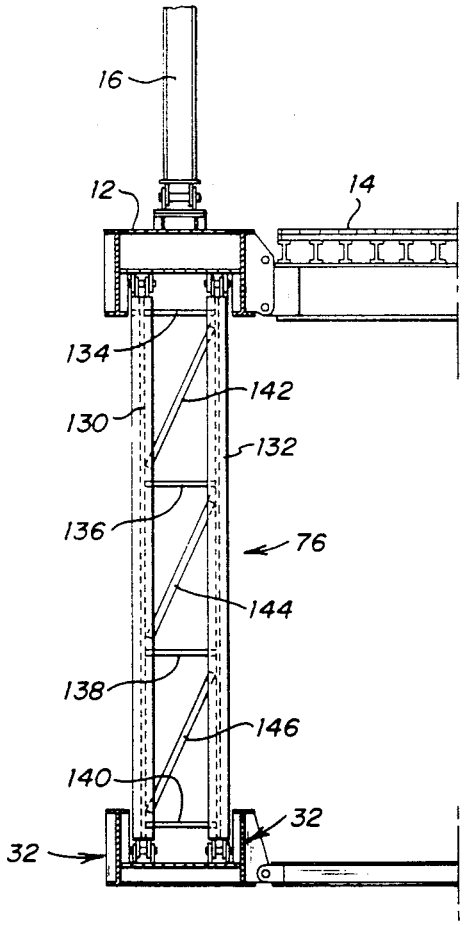
FIG. 7 is a frontal view of a leg of the present structure.

FIG. 7 illustrates the construction of legs 76 and 78. Each leg 76 and 78 includes vertical members 130 and 132 interconnected by horizontal members 134, 136, 138 and 140. Additional support for leg 76 is also provided by diagonal members 142, 144 and 146. Leg 76 therefore provides lateral stability for structure 10. Additionally, supports 100 and 102 and links 40 and 42 may be similarly constructed as legs 76 and 78 illustrated in FIG. 7.

In a typical embodiment of the present structure, the length of legs 76 and 78 may be, for example, about 28 feet, the distance between vertical members 130 and 132 is about 4 feet and the distance from the bottom of base 32 to floor 14 is about 35 feet.

Thus there is provided a drill floor elevator and support system. It includes a pair of floor boxes 12 of about drill floor length. The boxes are laterally spaced at about drill floor width. A drill floor 14 is positioned between and supported by the floor boxes. It is coupled between the confronting sides of the floor boxes. A derrick 16 stands erected above the drill floor as thus assembled.

A pair of elongated base boxes 32 are located each being parallel to and directly beneath one of the floor boxes. A pair of transverse pivot shafts 80, 84 is provided in each floor box and in each base box. The shafts in the given box are spaced apart with one shaft adjacent to each end of the floor boxes. Shafts 82, 86 equally spaced in the base boxes are at locations intermediate the length of the base boxes.

Four substantially vertical support legs 76, 78 are each of width about the width of the inside of the boxes. Each is pivoted at one end on a shaft in a floor box and at the other end on a shaft in a base box. This provides for support of the floor boxes, the drill floor and the derrick above the base boxes.

A pair of tensile links 40 pivot at one end of a floor box for rotation in a plane parallel to the sides of the boxes. Each tensile link with one end pivotally connected to the floor box is removably pinned at the other end to a pin connection at the end of the base box.

A pair of thrust links 42 each pivoted at one end 42*b* to a hinge shaft located between the pin connection and the pivot shaft in the base box. The thrust links are connected at the other end 42*a* to the pin ends 40*b* of the tensile links 40.

An actuator, shown in the form of a winch system 62 is connected between the base box in the region of the end of the pin connection and to the pinned end of the tensile legs to provide for raising and lowering the floor boxes and the associated floor by rotation of the supporting legs between horizontal and vertical positions.

It therefore can be seen that the present structure provides for an improved drill rig elevating floor system having improved longitudinal and lateral stability as well as providing for easy erection and maintenance.

Whereas the present invention has been described with respect to specific embodiments thereof, it will be understood that various changes and modifications will be suggested to one skilled in the art and it is intended to encompass such changes and modifications as fall within the scope of the appended claims.

I claim:

1. In an oil well drilling rig having a base for placement on the ground at a well site, the base having first and second ends, the rig further having a drill floor having first and second ends, the floor being disposed parallel to and adjacent the first end of the base, the floor additionally being coupled to the base by spaced apart parallel legs each pivotally attached between the floor and the base for elevating the floor from a low position adjacent to the first end of the base to an elevated position medially between the ends of the base and located above the base by rotation of the legs towards a vertical position, the improvement comprising:

tensile link means having first and second ends, said first end thereof being coupled adjacent the second end of the floor opposite the first end of the base;

thrust link means having first and second ends, said first end thereof being coupled adjacent said second end of said tensile link means and said second end thereof being pivotally coupled adjacent the second end of the base; and power driven means connected to the base and said link means for drawing said second end of said tensile link means to a pin linkage position on the base adjacent the second end of the base as the legs approach the vertical position.

2. The drilling rig of claim 1 and further including:

support means connected at one end thereof to the end of the leg adjacent the floor and the other end thereof adapted to be pinned to the base.

3. The drilling rig of claim 1 wherein said power driven means includes:

winch means connected to the base;

first sheave means connected adjacent said second end of said tensile link means;

second sheave means connected adjacent the second end of the base; and means interconnecting said winch and said sheave means.

4. The drilling rig of claim 3 wherein said means interconnecting said winch means and said sheave means includes wireline means.

5. The drilling rig of claim 2 wherein said support means includes:

first and second vertical members;

a plurality of horizontal members interconnected between said vertical members; and a plurality of diagonal members disposed between said vertical members and between said horizontal members.

6. A drill floor elevator and support system, comprising:

(a) a pair of floor boxes of about drill floor length laterally spaced at about drill floor width and positioned in parallel relation with a drill floor supported by and between said floor boxes and above which a derrick stands;

(b) a pair of elongated base boxes one parallel to and below each of said floor boxes;

(c) a pair of transverse pivot shafts in each of said boxes, spaced apart with one shaft located adjacent to each end of each of said floor boxes and equally spaced but located intermediate the length of said base boxes;

(d) four substantially vertical support legs each of width about the width of the inside of said boxes and each pivoted at one end on one of said shafts in said floor boxes and at the other end to one of said shafts in said base boxes for support of said floor boxes, said drill floor and derrick above said base boxes;

(e) a pair of tensile links each connected to an end of a floor box for pivotal movement in an arc parallel the sides of said boxes, and each connected at a pin end to a releasable pin connection at the end of a base box;

(f) a pair of rigid thrust links each pivoted at one end to a hinge shaft located on a base box between said pin connection and a pivot shaft in said base box and connected at the other end to said pin end of said tensile link for lowering and elevating said drill floor and derrick by control through said thrust link of the movement away from and toward said pin connection of said pin end whereby said support legs pivot away from said pin connection to lower said drill floor and derrick and pivot toward said pin connection to elevate said drill floor and derrick.

7. The combination set forth in claim 6 in which said tensile link is rigid for withstanding both tensile and compression forces.

8. The combination as set forth in claim 6 in which said support legs lean at a minor angle from vertical away from said tensile links, and said tensile links slope upward toward said floor at a larger angle.

9. The combination as set forth in claim 6 in which actuators are coupled between said base boxes in the region of each said pin connection and the region common to said tensile link and said thrust link to lower and raise said drill floor by rotation of said legs between horizontal and vertical positions.

* * * * *